United States Patent [19]

Bond

[11] 4,370,375

[45] Jan. 25, 1983

[54] ABRASION-RESISTANT MONOFILAMENT WITH MOLYBDENUM DISULFIDE USEFUL IN THE FORMATION OF PAPERMAKING BELTS

[75] Inventor: William B. Bond, Marietta, Ohio

[73] Assignee: E. I. Du Pont de Nemours and Company, Wilmington, Del.

[21] Appl. No.: 255,743

[22] Filed: Apr. 20, 1981

[51] Int. Cl.[3] ..... D03D 15/10; D21F 7/08

[52] U.S. Cl. ..... 428/229; 34/116; 34/123; 139/420 A; 162/348; 162/358; 162/DIG. 1; 428/401

[58] Field of Search ..... 428/225, 401, 229; 139/420 A; 162/358, 348, DIG. 1; 34/116, 123

[56] References Cited

U.S. PATENT DOCUMENTS

| | | | |
|---|---|---|---|
| 2,849,415 | 8/1958 | Stott | 260/37 |
| 2,855,377 | 10/1958 | Stott | 260/37 |
| 3,164,947 | 1/1965 | Gaston | 57/140 |
| 3,239,485 | 3/1966 | Koch | 260/45.75 |
| 3,493,544 | 2/1970 | Goodman et al. | 260/78 |
| 4,154,886 | 5/1979 | Yamazaki | 428/200 |

FOREIGN PATENT DOCUMENTS

| | | |
|---|---|---|
| 1557047 | 2/1969 | France . |

*Primary Examiner*—James C. Cannon

[57] ABSTRACT

Polyamide monofilaments containing molybdenum disulfides exhibit outstanding resistance to abrasive forces applied transversely to the longitudinal dimension of the monofilament, making the monofilaments particularly suitable for use in woven papermaking belts.

8 Claims, No Drawings

ABRASION-RESISTANT MONOFILAMENT WITH MOLYBDENUM DISULFIDE USEFUL IN THE FORMATION OF PAPERMAKING BELTS

BACKGROUND OF THE INVENTION

In the preparation of paper, woven support belts are used for the initial casting and subsequent treatment of the paper. These belts are known as paper clothing. A variety of materials has been used in the manufacture of such belts, including metals, and, more recently, thermoplastic monofilaments. Thermoplastic materials which have been used in the weaving of these belts include nylon as well as polyester monofilaments.

A particularly satisfactory combination of materials for paper clothing is a polyester monofilament, woven in the machine direction of the belt, with transverse monofilaments composed either partly or entirely of a polyamide monofilament. Particularly in such applications, a need exists for a polyamide monofilament having improved resistance to abrasion when the abrasive force is applied transversely to the longitudinal dimension of the monofilament.

SUMMARY OF THE INVENTION

The present invention provides a polyamide monofilament which exhibits outstanding resistance to abrasive forces applied transversely to the longitudinal dimension of the monofilament.

Specifically, the instant invention provides an oriented polyamide monofilament having a diameter of about from 3 to 30 mils and comprising filament-forming polyamide and about from 3 to 10 weight percent, based on the total weight of the monofilament, of molybdenum disulfide.

The instant invention further provides, in a woven, heat set, papermaking belt of machine and transverse direction thermoplastic filaments, the improvement wherein at least about 25% of the transverse direction filaments are oriented monofilaments having a diameter of about from 5 to 30 mils and comprising filament forming polyamide and about from 3 to 10 weight percent, based on the total weight of the filament, of molybdenum disulfide.

DETAILED DESCRIPTION OF THE INVENTION

The polyamides used for preparation of the oriented monofilaments of the present invention are non-cyclic polyamides of fiber-forming molecular weight having relative viscosity generally between 25 and 150 as determined by ASTM D-789-62T. These polyamides include, for example, polycaprolactam (6 nylon), polyhexamethylene adipamide (66 nylon), polyhexamethylene decanoamide (610 nylon), and polyhexamethylene dodecanoamide (612 nylon). Polyamide copolymers and polymer blends can also be used, such as those prepared from 6 nylon and 66 nylon. Of these, polyhexamethylene adipamide (66 nylon) and polyhexamethylene dodecanoamide (612 nylon) have been found to be particularly satisfactory for use in paper clothing.

In accordance with the present invention, about from 3 to 10 weight percent, and preferably about from 3 to 5 weight percent, of molybdenum disulfide is blended with the polyamide used for the preparation of the monofilaments. Less than about 3 weight percent of the molybdenum disulfide does not provide the markedly improved transverse direction abrasion resistance of the present invention, while quantities of molybdenum disulfide in excess of 20 weight percent of the monofilament unnecessarily weaken the filament with no further beneficial effects.

The molybdenum disulfide used in the present invention should be a substantially uniform particulate configuration. Preferably, the molybdenum disulfide has an average particle size of about from 1 to 8 microns. Particularly satisfactory are those molybdenum disulfides commercially available from Pfalz and Bauer.

In a preferred embodiment of the present invention, the polyamide composition further comprises about from 1 to 3 percent lithium bromide, and preferably 1 to 2 percent. The lithium bromide further improves the transverse abrasion resistance of the monofilaments prepared according to the present invention, particularly in combination with nylon 612.

The blending of the components of the monofilament can be carried out in any sequence convenient to the particular manufacturing operation involved. However, in general, it has been found convenient to dry blend the nylon used with the required quantity of molybdenum disulfide, together with any lithium bromide used.

After blending of the components, the monofilaments are prepared according to customary techniques. The molten nylon, blended with the molybdenum disulfide and any other additives, is extruded through a die into a quench medium, after which it is oriented. The monofilaments should be oriented about from 3.4 to 6.0 times their original length, and preferably about from 3.5 to 4.7 times their original length. In general, the diameter of the final monofilament should be about from 5 to 30 mils, and preferably about from 10 to 20 mils.

The monofilaments of the present invention can be woven into papermaking belts according to conventional weaving techniques. The type and density of the weave will, of course, depend on the type of paper and papermaking operation for which the belt is to be used. The present monofilaments are particularly satisfactory when used in combination with polyester monofilaments in a woven belt in which the polyester monofilaments make up the machine direction strands and the monofilaments of the present invention comprise at least about 25%, and preferably about from 25% to 50% of the transverse direction strands.

After weaving, the papermaking belts are heat set according to conventional techniques to stabilize the weave. Typical heat setting conditions will vary with the polymer, filaments, diameter and weave, but will typically involve heating under tension in a hot air oven for about from 15 minutes to 1 hour at a temperature of about from 300° to 400° F.

The improved monofilaments of the present invention, when used as transverse direction strands in papermaking belts, exhibit excellent resistance to the transverse direction abrasion encountered in belts of this type. This abrasion resistance permits improved operation for apparatus using such belts, in that the period between belt replacements is increased significantly.

The present invention is further illustrated in the following examples, in which parts and percentages are by weight unless otherwise indicated.

EXAMPLE 1 AND COMPARATIVE EXAMPLES A TO G

In Example 1 and Comparative Examples A to D, monofilaments of nylon 66 were prepared and tested having varying quantities of molybdenum disulfide, optionally together with lithium bromide. In Example 1, "Zytel 42", 66 nylon, commercially available form E. I. du Pont de Nemours and Company, was tumble-blended with molybdenum disulfide and the blend dried overnight in a vacuum oven with a nitrogen bleed. The blends of Comparative Examples A and B were prepared by the same method, with the addition of lithium bromide to the blend. In Comparative Example C, a 66 nylon having 2% molybdenum disulfide was used, commercially available as Nykon R from LNP Corporation. In Comparative Example D, a blend was prepared using 50% Nykon R and Zytel 42 66 nylon.

The dried blends were fed to a 1½" Hartig single-screw extruder maintained at temperatures ranging from about 240° C. in the feed end to 312° C. in the spin head. The molten blend was extruded through a 1-hole die to provide a finished monofilament of about 14 mils in diameter. The filament was pulled through 8 inches of air, quenched in water and then oriented by drawing in steam or radiant heat at the optimum draw ratio for each polymer blend.

The filaments were tested by bending four samples of each filament to be tested over a 0.016" steel wire and loading to a tension of 50 grams. The samples are forced against a stainless steel roller turning at 30–35 rpm at a load of 100 grams/sample. The four samples are kept wet throughout the test with a 10% slurry of Kaolin in water. The test was carried out for 6 hours. Break load and elongation of the four samples are then measured in an Instron tester and the means divided by the unabraded value to obtain percent retention for break load and elongation. The average of these two values is reported in Table I.

The test procedure was repeated, except that the 10% Kaolin was omitted from the water used to wet the samples, the roller was tool steel instead of stainless steel and the test period was 3 hours instead of 6. The results are reported in Table I.

In Comparative Examples E, F and G, the testing procedure was repeated using commercially available oriented monofilaments of substantially the same caliper. None of the commercially available monofilaments contained molybdenum disulfide additive. Comparative Example E was "ME-1865", nylon 66 monofilament commercially available from E. I. du Pont de Nemours and Company. Comparative Example F was oriented polyester monofilament commercially available as WP-130 from Shakepeare Company. Comparative Example G was oriented nylon 66 monofilament containing grafted ethylene copolymer.

The results of the testing are summarized in Table I.

EXAMPLES 2 AND 3 AND COMPARATIVE EXAMPLES H TO P

In Examples 2 and 3 and Comparative Examples K, L and M, nylon 612, commercially available as Zytel 158 from E. I. du Pont de Nemours and Company, was blended with molybdenum disulfide, optionally together with lithium bromide. In Comparative Examples H, I and J, polymer blends were prepared from Zytel 158 polyamide and Nykon I polyamide, commercially available from LNP Corporation and containing 2% molybdenum disulfide.

The polymer blends were dried in a vacuum oven at 120° C. with a nitrogen bleed. Monofilaments were extruded as described in Example 1 except that the extrusion temperatures were about 225° to 260° C. at the feed end and about from 250° to 300° C. at the spin head, using a 0.59" diameter die and orienting the monofilaments 3.6 to 4.0X. The oriented filaments were conditioned at 180° C.

In Comparative Examples N, O and P, commercially available monofilaments were used. In Comparative Example N, the monofilament was Vylor 0900 nylon 612, commercially available from E. I. du Pont de Nemours and Company. In Example O, a polyester monofilament was used, commercially available as WP-130 from the Shakespeare Company. In Comparative Example P, the monofilament was nylon 612 containing grafted ethylene copolymer, commercially available from E. I. du Pont de Nemours and Company.

The monofilaments were tested according to the procedure used in Example 1 with a 10% slurry of Kaolin in water and a stainless steel roller. The results are summarized in Table II.

EXAMPLE 4

A concentrate of 20 weight percent molybdenum disulfide in nylon 612 was prepared by blending the components in a ratio of 5 pounds of molybdenum disulfide to every 20 pounds of nylon 612. The nylon had an inherent viscosity in meta-cresol of 1.10–1.25. The blended flake was dried overnight in a vacuum oven at a temperature above the boiling point of water. The blend then was extruded on a 1½ inch screw melter at 15 pounds per hour, quenched in water after passage through a 6 inch air gap and fed to a cutter at 68 feet per minute. Thirty pounds of this flake was then blended with 120 pounds of nylon 612, tumbled for 30 minutes and then fed to an 83 mm. twin-screw extruder at 141 pounds per hour with a screw speed of 130 rpm and a barrel temperature of 255° to 265° C. under 6 inches of water vacuum at the vent port. The molten polymer was fed to eight two-stream, five-capacity Zenith gear pumps, filtered through a stack of 33 metal screens, extruded through a 0.060" single-hole die, and quenched in water after passage through a 6 inch air gap. The filament was immediately drawn 3.5X in a radiant heater at 840° C., passed through a hot air-conditioning oven at 200° C. for 1.4 seconds, and removed from the oven at 20 grams tension to cooling rolls after which it was wound on spools at 2020 feet per minute.

The filament was tested as in Examples 2 and 3, and the results summarized in Table II.

TABLE I

NYLON 6-6 COMPOSITIONS

| Example | Additive | Wt. % Added | Caliper Mils | Break Load Lbs | Elongation To Break % | Tensile Strength M psi | Draw Ratio | Draw Assist | Relative Viscosity | Average % Retention of Break Load & Elongation: Water | Average % Retention of Break Load & Elongation: 10% Kaolin |
|---|---|---|---|---|---|---|---|---|---|---|---|
| 1 | $MoS_2$ | 4.0 | 14.5 | 5.6 | 15 | 33 | 3.4 | Radiant | 62 | 98 | 76 |
| A | $MoS_2$ | 2.0 | 13.8 | 9.5 | 29 | 64 | 4.0 | Radiant | 50 | — | 62 |
| | LiBr | 1.1 | | | | | | | | | |
| B | $MoS_2$ | 2.0 | 13.9 | 11.8 | 36 | 78 | 4.0 | Radiant | 48 | — | 55 |
| | LiBr | 3.3 | | | | | | | | | |

TABLE I-continued

NYLON 6-6 COMPOSITIONS

| Example | Additive | Wt. % Added | Caliper Mils | Break Load Lbs | Elongation To Break % | Tensile Strength M psi | Draw Ratio | Draw Assist | Relative Viscosity | Average % Retention of Break Load & Elongation Water | 10% Kaolin |
|---|---|---|---|---|---|---|---|---|---|---|---|
| C | $MoS_2$ | 2.0 | 13.8 | 8.7 | 20 | 59 | 2.8 | Radiant | 39 | 62 | — |
| D | $MoS_2$ | 1.0 | 13.6 | 7.1 | 31 | 48 | 3.1 | Steam | 109 | 42 | — |
| E | None | | 14.4 | 11.6 | 27 | 71 | — | — | 67 | 53 | 47 |
| F | None | | 15.8 | 16.3 | 48 | 84 | — | — | — | 61 | 39 |
| G | None | | 14.4 | 10.6 | 29 | 65 | — | — | 65 | 66 | 51 |

TABLE II

| Example | Weight % Additive $MoS_2$ | LiBr | Caliper Mils | Break Load Lbs | Break Elong. % | Initial Modulus M psi | Tensile Strength M psi | Draw Ratio | Draw Assist | Inherent Viscosity | Average % Retention of Breakload & Elongation |
|---|---|---|---|---|---|---|---|---|---|---|---|
| 2 | 4 | None | 13.2 | 6.0 | 39 | 360 | 43 | 3.1 | Steam | — | 48 |
| | | | | | | | | 3.7 | Radiant | — | 62 |
| 3 | 4 | 1.8 | 14.3 | 7.6 | 25 | 363 | 50 | 4.0 | Radiant | — | 49 |
| H | None | None | 13.7 | 8.3 | 39 | 436 | 57 | 4.0 | Steam | 0.93 | 42 |
| I | 1 | None | 13.6 | 6.4 | 28 | 432 | 45 | 4.0 | Steam | 1.04 | 46 |
| J | 2 | None | 14.0 | 5.7 | 35 | 391 | 37 | 3.7 | Steam | 1.19 | 50 |
| K | None | None | 13.5 | 6.8 | 41 | 384 | 48 | 3.6 | Steam | — | 40 |
| L | 2 | 2.6 | 13.6 | 8.2 | 31 | 430 | 56 | 4.0 | Radiant | — | 57 |
| M | None | None | 13.2 | 7.6 | 37 | 387 | 55 | 4.0 | Steam | — | 44 |
| N | None | None | 13.5 | 9.6 | 24 | 610 | 67 | — | — | 0.97 | 38 |
| O | None | None | 15.8 | 16.3 | 48 | 1080 | 84 | — | — | — | 39 |
| P | None | None | 13.6 | 9.2 | 23 | 549 | 63 | — | — | 0.94 | 29 |
| 4 | 4 | None | 13.9 | 6.8 | 42 | 396 | 44 | 3.5 | Radiant | 1.12 | 41 |

I claim:

1. A polyamide monofilament characterized by improved transverse abrasion resistance, oriented about from 3.4 to 6.0 times the original length, having a diameter of about from 5 to 30 mils and comprising filament-forming polyamide and about from 3 to 10 weight percent, based on the total weight of the monofilament, of molybdenum disulfide.

2. A monofilament of claim 1 further comprising about from 1 to 3 weight percent lithium bromide.

3. A monofilament of claim 1 wherein the molybdenum disulfide comprises about from 3 to 5 weight percent.

4. A monofilament of claim 1 wherein the polyamide consists essentially of nylon 66.

5. A monofilament of claim 1 wherein the polyamide consists essentially of nylon 612.

6. A monofilament of claim 1 wherein the molybdenum disulfide has an average particle size of about from 1 to 8 microns.

7. In a woven, heat set, papermaking belt of machine and transverse direction thermoplastic filaments, the improvement wherein at least about 25% of the filaments in the transverse direction are monofilaments having a diameter of about from 5 to 30 and comprising filament forming polyamide and about from 3 to 10 weight percent, based on the total weight of the filament, of molybdenum disulfide.

8. A papermaking belt of claim 8 wherein the polyamide monofilaments comprise about from 25% to 50% of the transverse direction strands.

* * * * *